US007443105B2

(12) United States Patent
Xiequn

(10) Patent No.: US 7,443,105 B2
(45) Date of Patent: Oct. 28, 2008

(54) BALLAST CIRCUIT FOR GAS DISCHARGE LAMPS

(75) Inventor: Chen Xiequn, Shanghai (CN)

(73) Assignee: American Electric Cord, Inc. (CN)

( * ) Notice: Subject to any disclaimer, the term of this patent is extended or adjusted under 35 U.S.C. 154(b) by 272 days.

(21) Appl. No.: 11/424,283

(22) Filed: Jun. 15, 2006

(65) Prior Publication Data

US 2007/0290627 A1 Dec. 20, 2007

(51) Int. Cl.
*H05B 37/02* (2006.01)

(52) U.S. Cl. ..... 315/209 R; 315/224; 315/307

(58) Field of Classification Search ..... 315/224, 315/291, DIG. 7, 302, 307, 209 R
See application file for complete search history.

(56) References Cited

U.S. PATENT DOCUMENTS 4,053,813 A 10/1977 Kornrumpf et al.
4,060,751 A 11/1977 Anderson
4,276,496 A 6/1981 Arena-Ochoa
4,900,986 A 2/1990 Hammer et al.
5,023,519 A 6/1991 Jensen
5,311,102 A 5/1994 Du
5,453,667 A 9/1995 Matsuda et al.
5,942,859 A * 8/1999 Okude et al. ..... 315/291
5,961,204 A 10/1999 Martich et al.
6,291,945 B1 9/2001 Toyama et al.

OTHER PUBLICATIONS

International Rectifier Preliminary Data Sheet PD60062-L, IR2153D(S) & (PbF), Self-Oscillating Half-Bridge Driver.

* cited by examiner

*Primary Examiner*—David Hung Vu
(74) *Attorney, Agent, or Firm*—Stephen M. Nipper; Dykas, Shaver & Nipper, LLP

(57) ABSTRACT

A ballast circuit for a gas discharge lamp, having the capability to shift frequency after starting to reduce electromagnetic interference (EMI). Embodiments of the circuit contain an oscillator circuit that generates and supplies an oscillating signal and a time delay circuit, which generates a time delay to signal the oscillator to shift frequency. In embodiments of the circuit, the frequency shift is achieved by selecting different passive components used to generate the oscillator frequency.

18 Claims, 5 Drawing Sheets

BALLAST CIRCUIT FOR GAS DISCHARGE LAMPS

FIELD OF THE INVENTION

The present invention relates to ballast circuits for starting gas discharge lamps, and more particularly, to an improved, rapid start ballast circuit for a fluorescent lamp that switches from a first frequency to a second frequency for more efficient and reliable starting of the lamp.

BACKGROUND OF THE INVENTION

A gas discharge lamp is a well-known light source that typically consists of a glass envelope containing a low-pressure gas such as argon, krypton, neon, or a mix of these gases, and a quantity of an ionizable material such as mercury.

The lamp emits light by creating an electric arc passing through the gas. The arc is created by applying a large Alternating Current (AC) voltage across the cathodes of the lamp.

A fluorescent lamp is a well-known type of gas discharge lamp. A typical fluorescent lamp consists of an elongate gas envelope having an interior wall coated with a suitable phosphor, and having a cathode at each end of the envelope for application of an AC voltage across the lamp.

In operation, the gas discharge lamp appears as a negative impedance device; that is, the voltage drop across a gas discharge lamp will tend to decrease with increasing discharge current. Thus, a high voltage is required to create or strike the arc through the lamp followed by a lower voltage to maintain the arc once the arc is struck.

A ballast circuit is normally used to provide a high starting voltage and to provide a positive series impedance for other current limiting mechanisms to maintain the arc voltage once the lamp is struck. In a typical ballast circuit, the ballasting function is generally provided by an inductor connected in series with the gas discharge lamp. A gas discharge lamp has a natural frequency; that is the lowest frequency at which the gas discharge lamp will resonate without the addition of any external inductance or capacitance.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
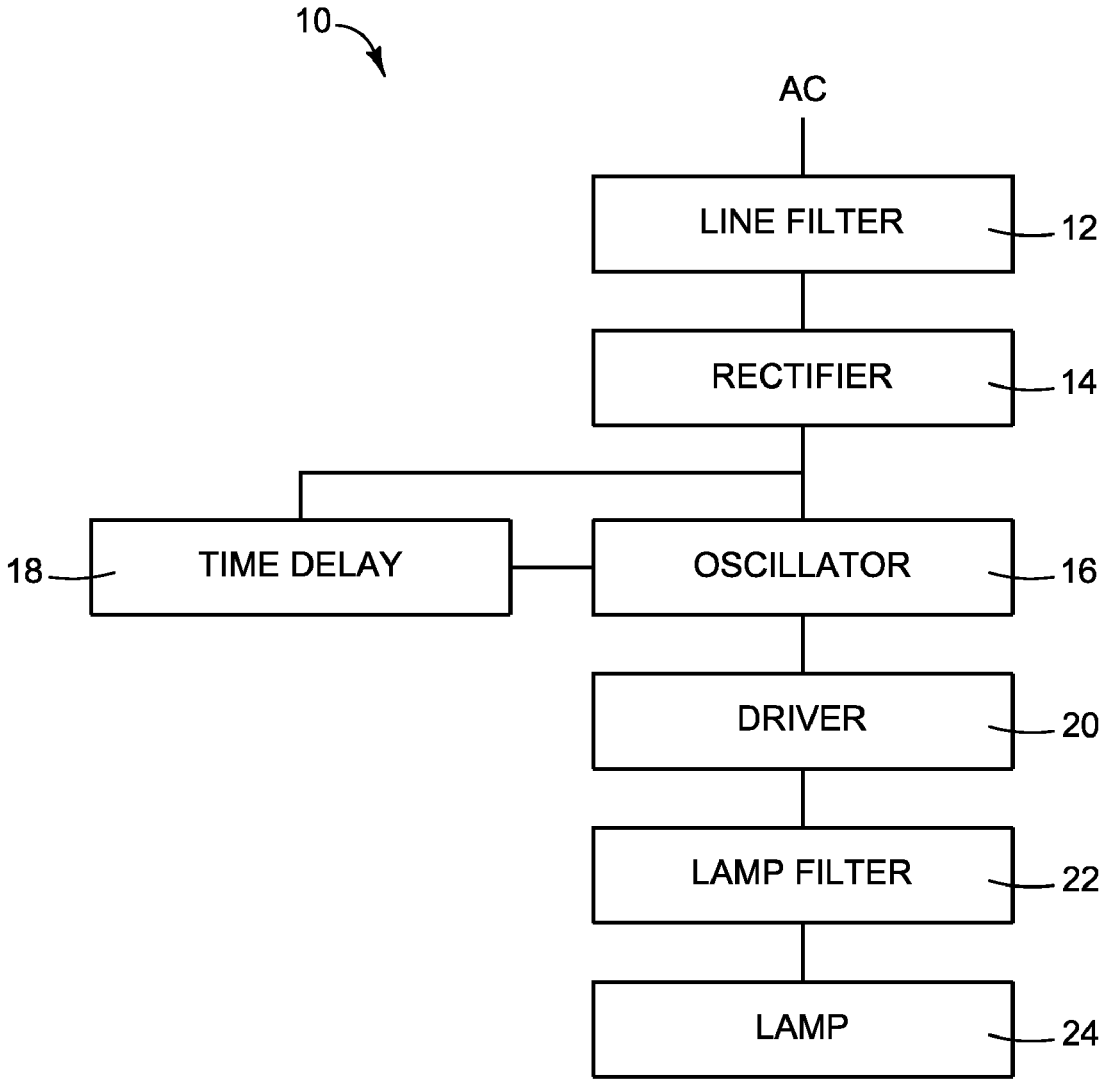
FIG. 1 is a block diagram of a ballast circuit for a gas discharge lamp.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "or" indicates a non-exclusive alternative without limitation unless otherwise noted.

A gas discharge lamp will start most easily when operated at its natural frequency. Therefore, ballast circuits are commonly designed to operate at the natural frequency of the gas discharge lamp. However, operation at this frequency often generates undesirable, harmonic signals, which then may radiate as Electro Magnetic Interference (EMI). Thus, it is often desirable to operate the lamp at a lower frequency after starting to reduce the radiation of undesirable harmonics.

Referring to FIG. 1, a block diagram of a ballast circuit, ballast circuit 10 includes a filter 12, which suppresses high frequency noise that may exist on the AC power input. The filtered signal is then supplied to a rectifier circuit 14 that converts the alternating current line signal to a continuous signal for use by the remaining components. The continuous current signal (i.e. direct current signal) is then supplied to an oscillator circuit 16 and a time delay circuit 18. The oscillator circuit 16 provides a high frequency signal to a lamp or bulb driver circuit 20, which in turn drives lamp 24 with a high frequency, high voltage signal. Lamp filter circuit 22 suppresses high frequency harmonics generated by lamp or bulb driver circuit 20.

Time delay circuit 18 switches the output frequency of oscillator circuit 16 from a first frequency to a second frequency upon the expiration of a time delay triggered by an event. In some embodiments of the ballast circuit, the event triggering the time delay is application of power to the oscillator circuit 16. In other embodiments, the event may be provided, without limitation, by a user-manipulated switch.

The construction and operation of circuits for line filter circuit 12, rectifier circuit 14 and lamp filter circuit 22, are well understood by those skilled in the art.

Figure 2:
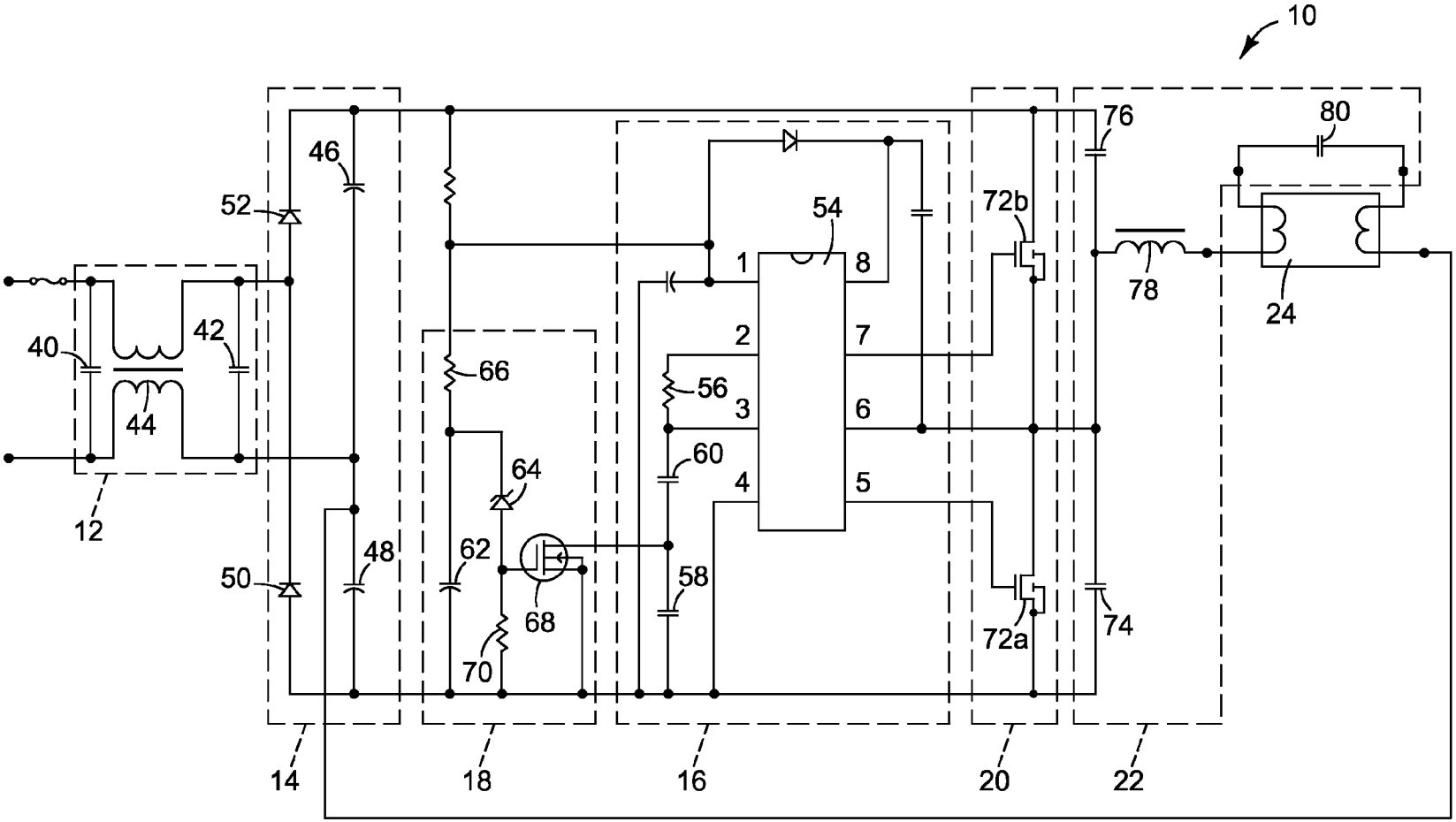
FIG. 2 is a schematic diagram of an embodiment of a ballast circuit for supplying electrical energy to a single gas discharge lamp.

FIG. 2 is a circuit diagram of the ballast circuit shown in FIG. 1. Referring to FIG. 2, an embodiment of line filter 12 includes a first capacitor 40, a second capacitor 42 in parallel with a transformer 44. Line filters are well known to those skilled in the art and the ballast circuit 10 is not limited to the particular embodiment of the line filter shown.

In a preferred embodiment, the value of capacitor 40 is 0.1 uF, the value of capacitor 42 is 0.1 uF, and the value of transformer 44 is 60 mH.

Rectifier circuit 14 includes capacitors 46 and 48 connected to diodes 50 and 52 to form a full wave rectifier circuit. Again, rectifier circuits are well known to those skilled in the art and the ballast circuit is not limited to the particular rectifier circuit shown in FIG. 2. In a preferred embodiment of the rectifier circuit 14, the value of capacitors 46 and 48 are 22 uF.

An embodiment of oscillator circuit 16 includes a self-oscillating, half-bridge driver circuit in oscillator module 54. In the embodiment shown, this function is provided by an IR2153 device, provided by International Rectifier®. While the use of an integrated circuit is particularly convenient, the ballast circuit 10 is not limited to the use of an integrated circuit oscillator, or a particular part supplied by International Rectifier®. For example, an oscillator comprising discreet components may be used. In one embodiment, the discreet components may parallel the internal components provided by the IR2153 integrated circuit. Other oscillators are well known to those skilled in the art.

In the embodiment shown, the frequency of oscillation is set by discreet components: a resistor 56, a first capacitor 58, and a second capacitor 60. The frequency of operation may be selected by examining the data sheet for oscillator module 54 in selecting the appropriate values of resistor 56 and capacitors 58 and 60. Note that the oscillator will operate at a first frequency when the value for capacitor 60 is selected, and capacitor 58 is essentially removed from the circuit by the time delay circuit 18 in the manner described below. Oscillator module 54 will operate at a second frequency when capacitors 58 and 60 are in series, essentially adding their capacitance values.

An embodiment of time delay circuit 18 includes a capacitor 62 in parallel with a zener diode 64. Capacitor 62 and zener diode 64 are connected to resistor 66, and transistor 68 is connected to zener diode 64. In operation, capacitor 62 is charged by current passing through resistor 66. When the voltage on capacitor 62 exceeds the breakdown voltage of zener diode 64, zener diode 64 conducts current and turns on transistor 68, which shorts first capacitor 58 and changes the operating frequency of oscillator module 54. Resistor 70 is used to bias transistor 68. In the embodiments shown, transistor 68 is an n-channel Field Effect Transistor (FET). However, persons skilled in the art will recognize that other transistors may be used with appropriate changes to bias circuitry, such as, without limitation, bipolar transistors a p-channel FETs.

In a preferred embodiment of time delay circuit 18, the value for resistor 66 is 510K ohms, the value for capacitor 62 is 4.7 uF, and diode 64 has a breakdown voltage of 8.2 volts. Time delay circuit 18 is set primarily by the values of capacitor 62 and resistor 66.

Referring again to FIG. 2, driver circuit 20 includes two driver transistors: transistor 72*a* and transistor 72*b*. In a preferred embodiment, transistors 72*a* and 72*b* may each an n-channel FETs, with the gates driven by oscillator circuit 16. While n-channel FETs are used in the embodiment shown, persons skilled in the art will recognize that other drivers may be used, such as bipolar transistors or p-channel FETs, with appropriate changes in bias circuits.

Lamp filter circuit 22 includes capacitor 74 and capacitor 76 connected in parallel with transistors 72*a* and 72*b*, respectively. Lamp filter circuit 22 may optionally include inductor 78 connected in series with lamp 24. Lamp filter circuit 22 may also optionally include capacitor 80 connected in parallel with lamp 24.

In a preferred embodiment, capacitors 74 and 76 have values of 1000 pF. Inductor 78 has a value of 2.5 mH and capacitor 80 has a value of 0.01 uF.

Focusing now on the operation of time delay circuit 18 and oscillator circuit 16, when power is applied at the input to the ballast circuit, power will be applied to the oscillator circuit 16 and to the time delay circuit 18. At this stage of operation, transistor 68 is off (non-conducting), and capacitors 60 and 58 are connected in series so that their capacitance values add and so that the frequency of operation depends on both their values.

When voltage is applied to the time delay circuit 18, current flows through resistor 66 and charging capacitor 62. As capacitor 62 charges to a voltage greater than the breakdown voltage of zener diode 64, zener diode 64 will conduct current through resistor 70, applying a voltage to the gate of transistor 68, turning transistor 68 on (i.e. conducting). As transistor 68 turns on, it essentially shorts capacitor 58 to ground, so that the frequency of oscillation depends on capacitor 60.

In a preferred embodiment, the values of capacitor 60 and 58 are chosen so that oscillator circuit 16 starts oscillating at the natural frequency of lamp 24. In the embodiment shown, the natural frequency is around 33 kilohertz. After a suitable time delay allowing the lamp 24 to start conducting and emitting light, the conduction by transistor 68 changes the frequency to a lower frequency, 25 kilohertz. At the lower frequency, less noise and fewer harmonics are generated by the driver circuit 20 and thus, less electromagnetic interference (EMI) is emitted by the ballast circuit. In the preferred embodiment shown, the value of resistor 56 is 28K ohms, the value of capacitor 58 is 3300 pF, and the value of capacitor 60 is 1000 pF.

Figure 3:
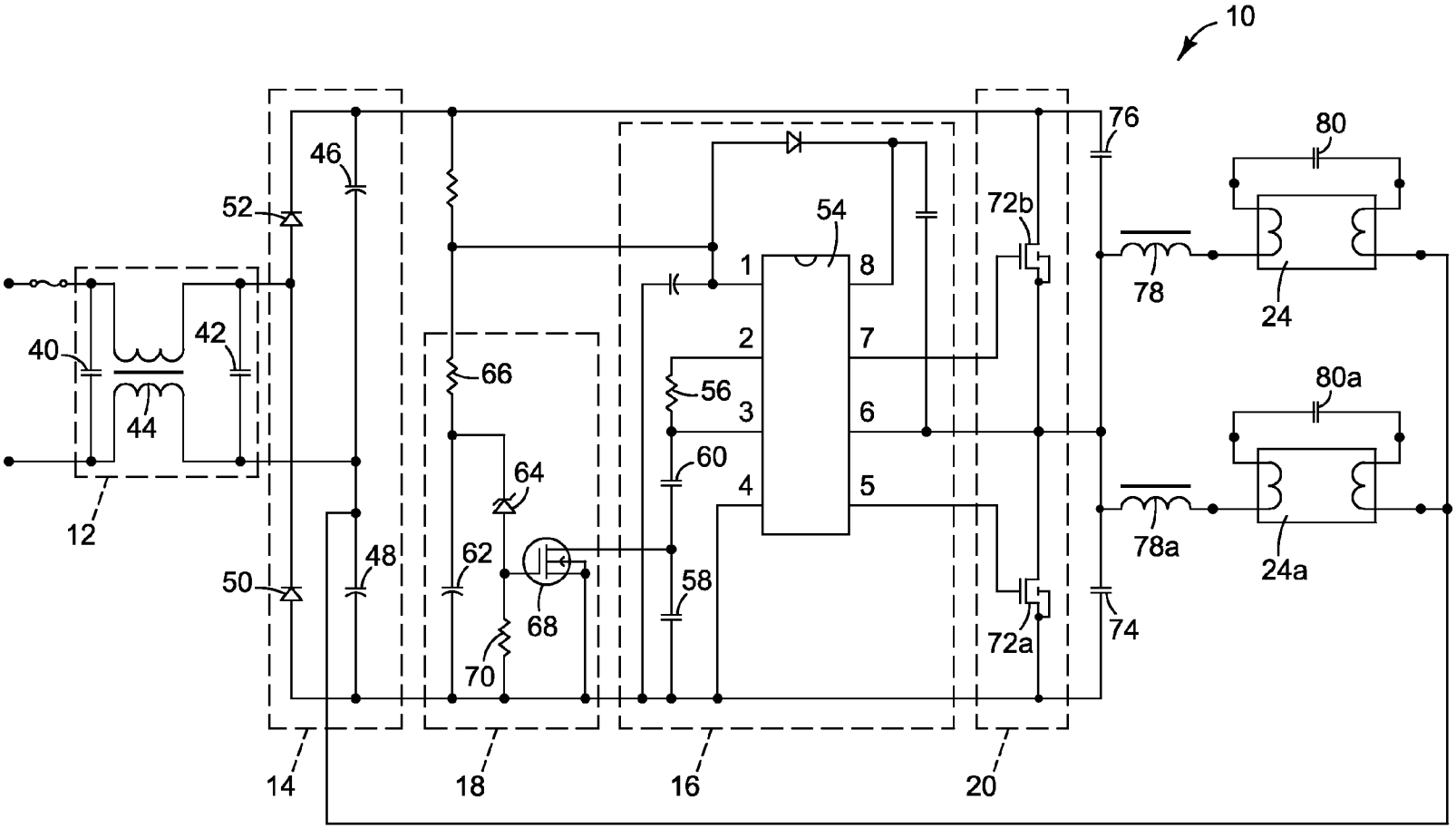
FIG. 3 is a schematic diagram of an embodiment of a ballast circuit for supplying electrical energy to two gas discharge lamps.

FIG. 3 shows a schematic diagram of a ballast circuit driving two lamps. To drive two lamps, the second lamp is essentially connected in parallel with the first lamp. In FIG. 3, similar components are numbered the same as in FIG. 2. Thus, a second capacitor 80*a*, a second conductor 78*a* and a second lamp 24*a* are connected to the output of the driver circuit 20.

Ballast circuit 10 may be implemented as a circuit board serving as a mounting surface for the various components of ballast circuit 10. The proper material of the circuit board and manner of mounting electrical components thereon are both well known to those skilled in the art.

Figure 4A:
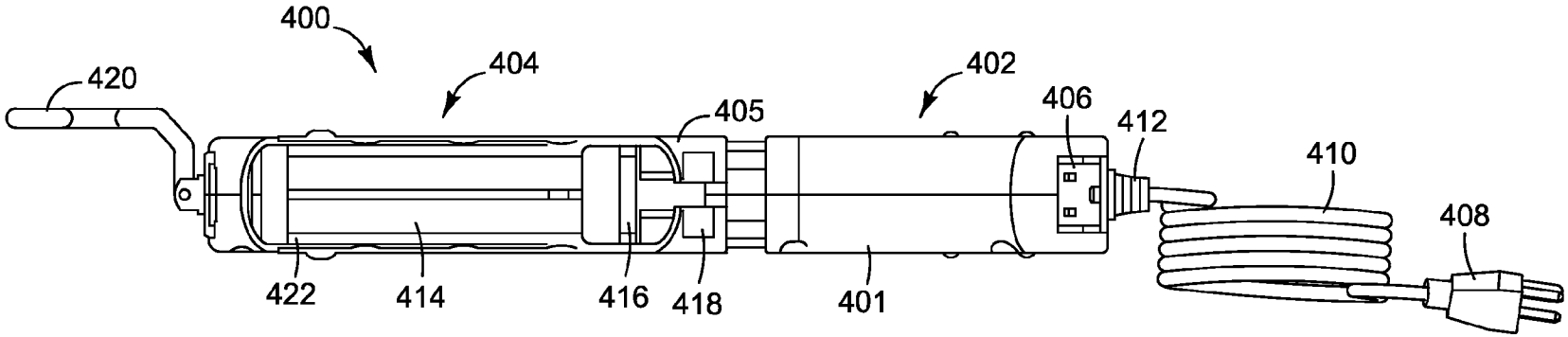
FIG. 4A is a front view of an embodiment of a droplight containing ballast circuits for a gas discharge lamp.
Figure 4B:
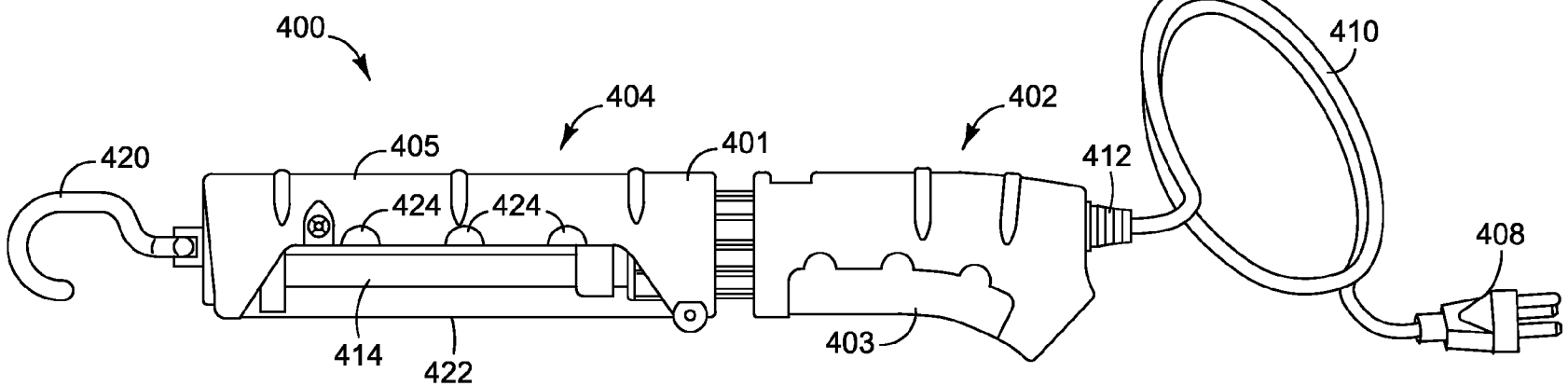
FIG. 4B is a side view of an embodiment of a droplight containing ballast circuits driving a single gas discharge lamp.

While ballast circuit 10 is useful for driving many types of gas discharge lamps in many types of applications, it is particularly useful in a fluorescent droplight. FIGS. 4*a* and 4*b* show front and side views of a portable fluorescent droplight 400.

Droplight 400 comprises a case 401 that forms a handle 402 and a light emitter cavity 404. Case 401 is preferably formed of high-impact plastic and may be split or constructed in two halves for ease of assembly. Case 401 also encloses various electrical components in droplight 400, including ballast circuit 10. Handle 402 may include ridges or a gripping structure 403 to assist the user in securely gripping droplight 400. Cavity 404 has an opening to project light emitted by lamp 414 onto a work surface or object selected by the user. Cavity 404 may further include a reflector constructed of generally reflective material located generally behind lamp 414.

Droplight 400 may also comprise an electrical jack 406. While a three—prong jack for 15 A, 120V service is shown; other styles of outlets may be used depending on country and current requirements. Electrical jack 406 makes the electrical power supplied to the portable fluorescent droplight 400 available to other devices that can be connected to the electrical outlet 406 in a manner well known in the art.

The portable fluorescent droplight 400 may also comprise an electrical plug 408, a power cord 410, and an optional strain relief 412. Strain relief 412 may be affixed to case 401 to retain a fixed end of power cord 410 in a well-known manner. Strain relief 412 alleviates tensile and lateral forces that arise between power cord 410 and case 401 due to movement of droplight 400 during use. In some embodiments, power cord 410 may be a three twisted conductor 16 AWG power cable of a type well known in the art. Similarly, plug 408 may be a grounded three prong male connector of a type well known in the art. Plug 408 is physically and electrically connected to a free end of power cord 410 in a well-known manner. The fixed end of power cord 410 is physically and electrically connected to the electrical jack 406 and to ballast circuit 10.

Gas discharge lamp 414 is electrically and physically connected to bulb socket 416. Bulb socket 416 also physically locates the lamp 414 within light emitter cavity 404 and supplies lamp 414 with regulated electrical power generated by ballast circuit 10.

Case 401 also supports a switch assembly 418 for controlling electrical power to ballast circuit 10 and lamp 414. An optional clear lens 422 may be used to protect lamp 24 during use. Lens 422 may be constructed of polyethersulfone (PES) or other suitably clear and durable material. Lens 422 may be supplied with optional vents 424 to dissipate heat produced by internal electrical components. Lens 422 may also be constructed in two layers: an inner layer may be used to prevent conductive heat transfer to an outer layer that is accessible to the user. An optional rotatable hook 420 may be supplied so that the user may hang droplight 400 for use. Rotatable hook 420 may be constructed of plastic, steel, or any other suitably strong material.

Case 401 may include internal structures to support droplight components, including jack 406, strain relief 412, lamp 24, bulb socket 416, switch assembly 418, and ballast circuit 10. Screws or snap fitting may be used to support each of the components.

Figure 5A:
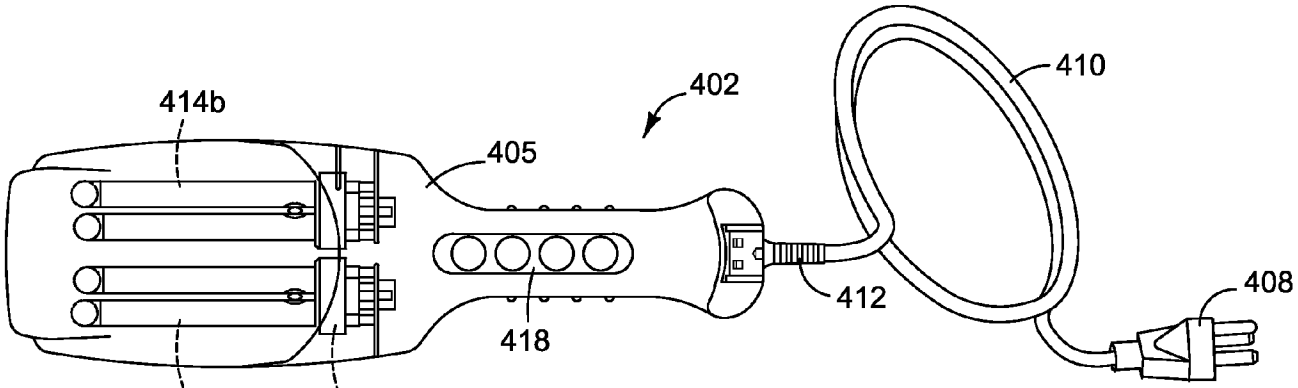
FIG. 5A is a front view of an embodiment of a droplight containing ballast circuits driving two gas discharge lamps.
Figure 5B:
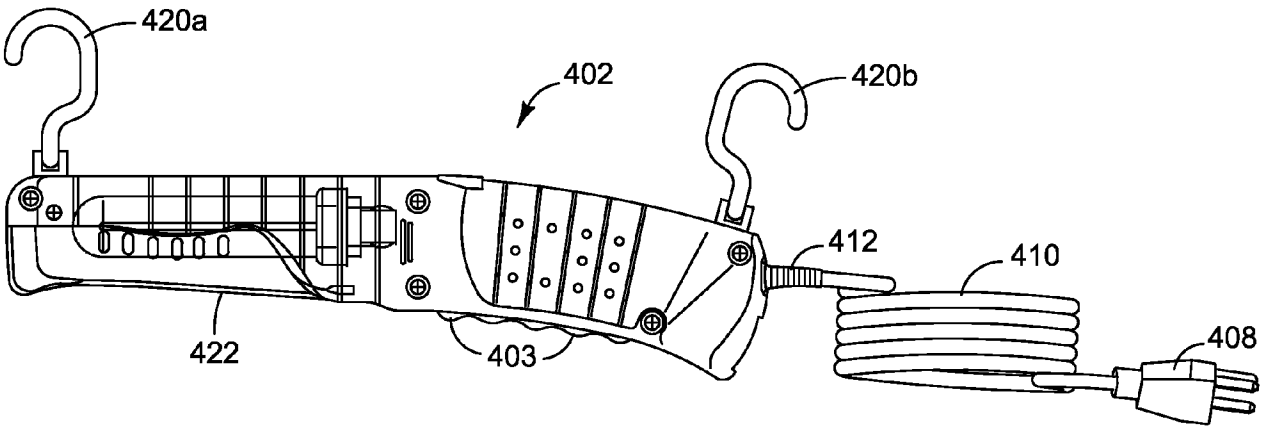
FIG. 5B is a side view of an embodiment of a droplight containing ballast circuits driving two gas discharge lamps.

FIGS. 5A and 5B show an alternative embodiment of droplight 400, employing two lamps, 414*a* and 414*b*, and two rotatable hooks, 420*a* and 420*b*.

The exemplary embodiments shown in the figures and described above, illustrate, but do not limit the invention. It should be understood that there is no intention to limit the invention to the specific form disclosed; rather, the invention is to cover all modifications, alternative constructions, and equivalents falling within the spirit and scope of the invention as defined in the claims. For example, while embodiments of the present invention were developed for fluorescent droplights, the invention is not limited to use with fluorescent droplights and may be used with other gas discharge lamps. Hence, the foregoing description should not be construed to limit the scope of the invention that is defined in the following claims.

What is claimed is:

1. A circuit for starting and operating a gas discharge lamp, the gas discharge lamp having a natural frequency, comprising:

a lamp driver circuit;

an oscillator circuit connected to the lamp driver circuit, the oscillator circuit having a first frequency of operation and a second frequency of operation, wherein oscillator circuit drives the lamp driver circuit at the natural frequency when the oscillator circuit operates at the first frequency, and the oscillator circuit drives the bulb driver circuit at a frequency other than the natural frequency when the oscillator circuit operates at the second frequency; and a time-delay circuit connected to the oscillator circuit, wherein the time-delay circuit switches the oscillator circuit operation from the first frequency to the second frequency upon a pre-selected time delay from a pre-selected event.

2. The circuit of claim 1, wherein the pre-selected event is the application of power to the oscillator circuit.

3. The apparatus of claim 1, wherein the first frequency of operation is selected to approximate the natural frequency of the gas discharge lamp.

4. The apparatus of claim 1, wherein the second frequency of operation is selected to reduce harmonic oscillations applied to the gas discharge lamp.

5. The apparatus of claim 1, wherein the first frequency of operation is set by a first capacitor value, the second frequency of operation is set by a second capacitor value, and the time-delay circuit switches from the first capacitor value to the second capacitor value.

6. The apparatus of claim 1, wherein the time-delay circuit comprises:

a transistor connected to the oscillator circuit; and a zener diode connected to a transistor so that the transistor conducts current when voltage applied to the zener diode exceed its zener breakdown voltage, wherein the time-delay circuit switches the oscillator circuit operation from the first frequency to the second frequency when the transistor conducts current.

7. The apparatus of claim 1, wherein the oscillator circuit comprises a self-oscillating, half-bridge driver.

8. The apparatus of claim 1, further comprising a rectifier circuit and a line filter circuit to provide power to the oscillator circuit.

9. The apparatus of claim 1, further comprising a lamp filter circuit configured to suppress harmonics applied to the gas discharge lamp.

10. The apparatus of claim 9, wherein the lamp filter circuit comprising at least one capacitor connected in parallel with the driver circuit.

11. A droplight, comprising:

a first gas discharge lamp having a natural frequency;

a case having a cavity adapted to emit light from the first gas discharge lamp;

a bulb driver circuit;

an oscillator circuit connected to the bulb driver circuit, the oscillator circuit having a first frequency of operation and a second frequency of operation, wherein oscillator circuit drives the bulb driver circuit at the natural frequency when the oscillator circuit operates at the first frequency, and the oscillator circuit drives the bulb driver circuit at a frequency other than the natural frequency when the oscillator circuit operates at the second frequency; and a time-delay circuit connected to the oscillator circuit, wherein the time-delay circuit switches the oscillator circuit operation from the first frequency to the second frequency upon a pre-selected time delay from a pre-selected event.

12. The droplight of claim 11, wherein the pre-selected event is the application of power to the oscillator circuit.

13. The droplight of claim 11, wherein the first frequency of operation is selected to approximate the natural frequency of the gas discharge lamp and wherein the second frequency of operation is selected to reduce harmonic oscillations applied to the gas discharge lamp.

14. The droplight of claim 11, wherein the first frequency of operation is set by a first capacitor value, the second frequency of operation is set by a second capacitor value, and the time-delay circuit switches from the first capacitor value to the second capacitor value.

15. The droplight of claim 11, wherein the time-delay circuit comprises:

a transistor connected to the oscillator circuit; and a zener diode connected to a transistor so that the transistor conducts current when voltage applied to the zener diode exceed its zener breakdown voltage, wherein the time-delay circuit switches the oscillator circuit operation from the first frequency to the second frequency when the transistor conducts current.

16. The droplight of claim 11, wherein the oscillator circuit comprises a self-oscillating, half-bridge driver.

17. The apparatus of claim 11, further comprising a rectifier circuit and a line filter circuit to provide power to the oscillator circuit.

18. The apparatus of claim 11, further comprising a lamp filter circuit configured to suppress harmonics applied to the gas discharge lamp.

* * * * *